US005176546A

United States Patent [19]

Shiratori

[11] Patent Number: 5,176,546

[45] Date of Patent: Jan. 5, 1993

[54] LEISURE BOAT

[75] Inventor: Koji Shiratori, Shizuoka, Japan

[73] Assignee: Shiratori Co., Ltd., Japan

[21] Appl. No.: 707,762

[22] Filed: May 30, 1991

Related U.S. Application Data

[62] Division of Ser. No. 524,077, May 16, 1990, Pat. No. 5,052,955.

[51] Int. Cl.[5] ..... B63H 21/17

[52] U.S. Cl. ..... 440/1; 114/346; 440/7; 440/84; 440/86

[58] Field of Search ..... 114/346, 357; 440/1, 440/7, 6, 75, 80, 84, 86, 81; 340/436

[56] References Cited

U.S. PATENT DOCUMENTS

| | | | |
|---|---|---|---|
| 3,391,669 | 7/1968 | Buster | 114/346 |
| 3,859,482 | 1/1975 | Matsui et al. | 340/436 |
| 4,163,268 | 7/1979 | Spies et al. | 340/436 |
| 4,723,500 | 2/1988 | Havins | 440/7 |
| 4,820,208 | 4/1989 | Phillips | 440/7 |
| 4,873,452 | 10/1989 | Morota et al. | 340/436 |

FOREIGN PATENT DOCUMENTS

| | | | |
|---|---|---|---|
| 2153750 | 8/1985 | United Kingdom | 114/357 |

*Primary Examiner*—Sherman Basinger
*Assistant Examiner*—Thomas J. Brahan

[57] ABSTRACT

A leisure boat is provided in a round form having a diameter of about 1 to 2 meters, and includes propeller means provided at a position closer to its bow from the center of the boat and the bow and having a mechanism for changing its driving direction and sensor means provided on the outside of the boat for sensing external force. The sensor means is so connected to the propeller means that when the boat comes in contact or collision with another boat, etc., the sensor means detects the resulting external force to transmit it to the propeller means, thereby changing its driving direction.

1 Claim, 2 Drawing Sheets

LEISURE BOAT

This is a divisional of copending application Ser. No. 07/524,077 filed on May 16, 1990, now U.S. Pat. No. 5,052,955.

BACKGROUND OF THE INVENTION

1. Field of the Invention

The present invention relates to a leisure boat of a small size, which is designed to be used on relatively limited waters such as ponds and pools in playgrounds.

2. Prior Art

Leisure boats heretofore used on relatively limited waters such as ponds and pools in playgrounds have a length as short as about 1-2 meters, and are designed to be propelled at a slow speed of a few meters per second by an outboard small propeller.

In addition, such boats are a sort of rubber boats having their bodies formed of a balloon designed so as to absorb shocks occurring when they collide with each other or strike against the borders of ponds or the walls of pools.

Such conventional small-sized leisure boats as mentioned above are of greater safety in use and so best-suited for use on limited waters such as ponds or pools in playgrounds. However, their defect is that because, in spite of their speed being slow, they are only permitted to be propelled forwardly, just like ordinary boats, they are so lacking in a pleasant thrill and comfortableness that they have the disadvantage that they are likely to become boring.

Thus, the present invention seeks to provide a leisure boat suitable for use on limited waters such as ponds or pools.

SUMMARY OF THE INVENTION

According to the present invention, this object is achieved by the provision of a leisure boat in a round form having a diameter of about 1 to 2 meters, which includes propeller means offset from the center of said boat and the bow and having a mechanism for changing its driving direction and sensor means provided on the outside of said boat for sensing external force, said sensor means being so connected to said propeller means that when said boat comes in contact or collision with another boat, etc., said sensor detects the resulting external force to transmit it to said propeller means, thereby changing its driving direction.

Preferably, a gasoline engine is used in association with the propeller means to selectively actuate one of a pair of propellers through a combined clutch and power transmission mechanism.

Preferably, the sensor is a piezoelectric element which detects shocks occurring at the time of colliding with boats, etc. or a push button type of tape-like switch which detects pressures occurring at the time of contacting boats, etc.

Alternatively, a reversible d.c. motor may be used in association with the propeller means to actuate a propeller connected to the motor through a foot switch and a reversible changeover switch.

Leisure boats are used on limited waters under crowded conditions so that they are likely to come in contact or collision with one another, but they are designed to be used with safety by reducing pressures or shocks occurring at the time of such contact or collision by their small dimensions and limited driving force.

According to the present invention accomplished with that fact in mind, a function capable of sensing external force produced by such contact or collision is provided at a suitable position on the outside of a boat, and connected to a propeller means so that when the boat comes in contact or collision with another boat, etc., it can change direction.

The leisure boat according to the present invention is in the form of a round boat including a propeller means mounted offset from the center of the boat and the bow and having a mechanism for changing its driving direction and a sensor means provided on the outside thereof, said sensor means being so connected to said propeller means that when said sensor detects contact or collision, said propeller means can change its driving direction. Thus, when the boat comes in contact with another boat or the shore of a pond, it changes direction, whereby it turns or moves backwardly. The sensor may be selectively immobilized by a manual switch.

BRIEF DESCRIPTION OF THE DRAWINGS

The present invention will now be described in greater detail, by way of example, with reference to the accompanying drawings, in which.

DESCRIPTION OF THE PREFERRED EMBODIMENT

Figure 1:
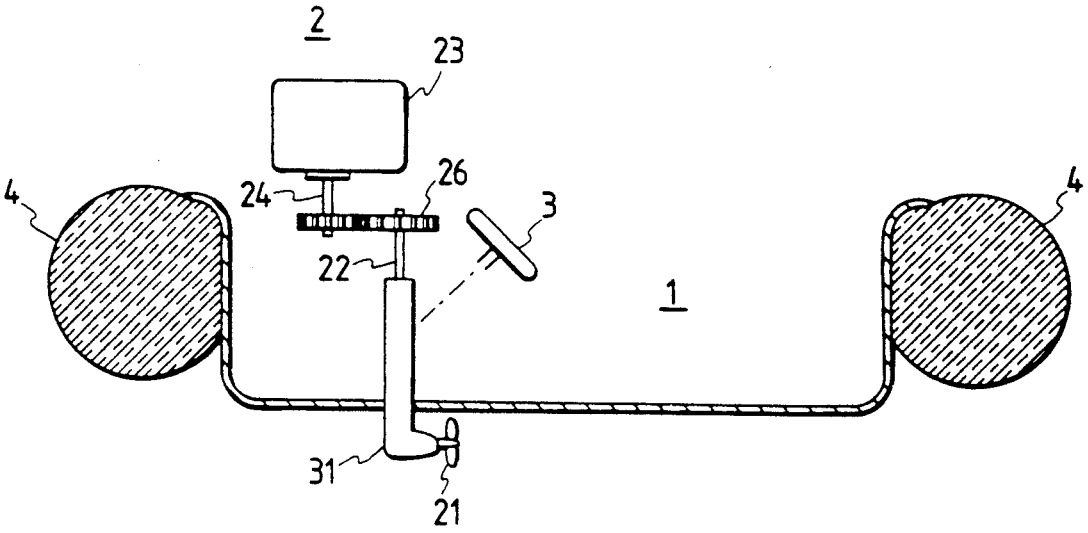
FIG. 1 is a longitudinally sectioned view showing a general structure of the leisure boat according to the present invention.
Figure 2:
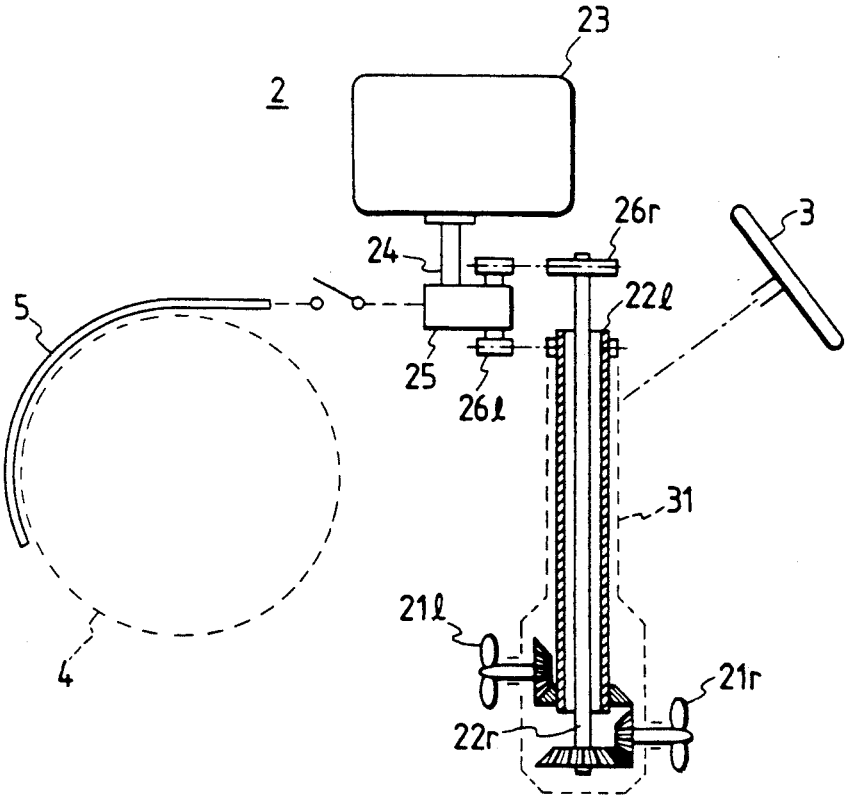
FIG. 2 is a longitudinally sectioned view showing one example of the propeller means.

A general structure of the leisure boat will first be described. This boat is constructed from a boat body 1, a propeller unit 2, a steering wheel 3 and other operational equipment, and further includes a sensor mechanism for sensing its contact or collision with another boats, the shore of a pond and so on to change its direction.

This leisure boat is substantially identical in the basic structure with conventional ones. That is to say, the present boat is in a round form having a diameter of about 1 to 2 meters and the boat body 1 is formed of a synthetic resin such as a FRP (a fiber reinforced plastic) for one or two boaters.

Within the boat body 1, there is attached a propeller unit 2 located offset from the center, which is operated by the steering wheel 3 and other operational equipment to drive the boat in every direction at a speed of about 1 to 5 meters per second.

Around the boat body 1, there are provided cushions 4 formed of a suitable lightweight and high-cushioning material such as balloon tires. The cushions 4 serve to absorb shocks occurring when the boat strikes against another boats, the shore of the pond, etc. and prevent the boat from turning turtle to maintain the safety of the boaters.

The propeller unit 2 comprises a propeller 21, a propeller shaft 22, an engine 23 and other parts. The propeller shaft 22 is connected to an output shaft of the engine through a power transmission mechanism 26 comprising gears, chains, etc. to make a connection between the engine 23 and the propeller 21. The steering wheel 3 is communicated to a bushing 31 of the propeller shaft, which is designed to turn the propeller 21 to control the driving direction.

The boat is described to be driven by a propeller in the instant embodiment, but may be driven by other means. For instance, the boat may be driven by jets. The engine used may be a gasoline engine, a d.c. motor driven by a battery, etc. What is essential in this connection is to use an engine which allows a boat to be safely and readily driven at a given speed.

This is also true of steering equipment. The steering wheel 2 alone is referred to in the instant embodiment, but it is to be noted that there are provided additional means such as an accelerator pedal, together with safety equipment which serves to stop the propeller unit upon a release of pedaling.

Figure 4:
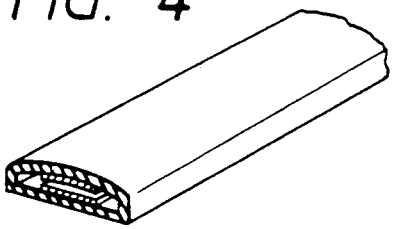
FIG. 4 is a perspective view of a push button type of a tape-like switch.

Usable as the sensor 5 is a conventional piezoelectric element or a push button type of a tape-like switch (FIG. 4). The push button type of a switch is suitable for detecting pressures produced by the contact of boats, etc. with each other. On the other hand, the piezoelectric element is suitable for detecting shocks exerted by a collision between boats, etc.

When the button type of tape-like switch is used, it is preferred that it is applied circumferentially over about 3/1 of the outside of the cushion 4. Preferably, a plurality of piezoelectric elements are scattered in place.

Figure 5:
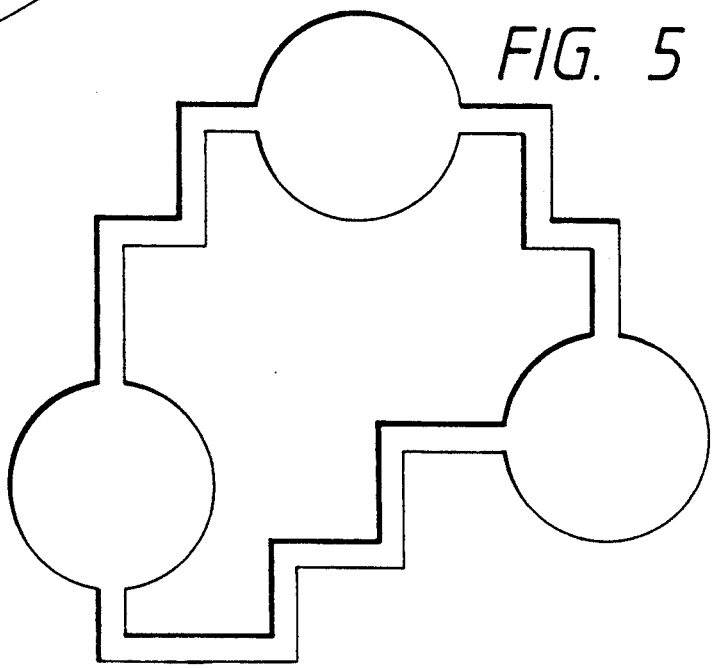
FIG. 5 is a plan view of ponds in a playground.

Reference will now be made to the mechanism for changing the direction of the boat to be propelled, when it strikes upon another boat or the shore of the pond. A typical example of a pond is illustrated in FIG. 5. The sensor 5 is attached to the outside of the cushion 4 over the boat body 1, which comes in contact or collision with another boat, etc., and serves to detect pressures or shocks produced by such pressures or shocks. On the other hand, the propeller unit 2 is provided with a mechanism for changing its driving force, which is so connected to the sensor 5 that it is actuated to change its driving direction upon receipt of a detecting output from the sensor 5.

In the instant embodiment, the propeller unit 2 is provided with two propellers 21*r* and 2*l* located at different angles of 90° to 180°. The propeller 21*r* is connected to one propeller shaft 22*r*, while the propeller 21*l* is coupled to the other propeller shaft 22*l*, whereby the rotation of one propeller is changed over to the rotation of the other propeller, thereby allowing the propeller unit 2 to change its driving direction. In other words, an engine 23 is provided on its output shaft 24 with a changeover clutch 25, which is so connected to the sensor 5 that it is actuated by a detecting output coming from the sensor 5.

Between the changeover clutch 25 and the propeller shaft 22*r*, there is mounted a power transmission mechanism 26*r*, while between it and the propeller shaft 22*l*, there is provided a power transmission mechanism 26*l*, whereby a driving force of the engine 23 is selectively transmitted to either one of the propellers 21*r* and 21*l* to rotate it.

In the instant embodiment, no reference is made to the mechanism for transmitting a detecting output from the sensor 5 to the changeover clutch 25. Usable to this end is either a system for transmitting mechanically to the changeover clutch 25 pressures or shocks which the sensor 5 receives when the boat comes in contact or collision with another boat, etc., or a system for converting such pressures or shocks to an electrical output for transmission. Which of the two systems is to be selected may be determined depending upon the structure of the changeover clutch 25.

As the thus constructed boat comes in contact or collision another boat, the shore of the pool or the like, the sensor detects such contact or collision to provide an abrupt change of the direction of the boat to be driven. In addition, the boat is caused to turn, because the propeller unit is mounted at a position closer to its bow from the center of the boat and the bow.

Figure 3:
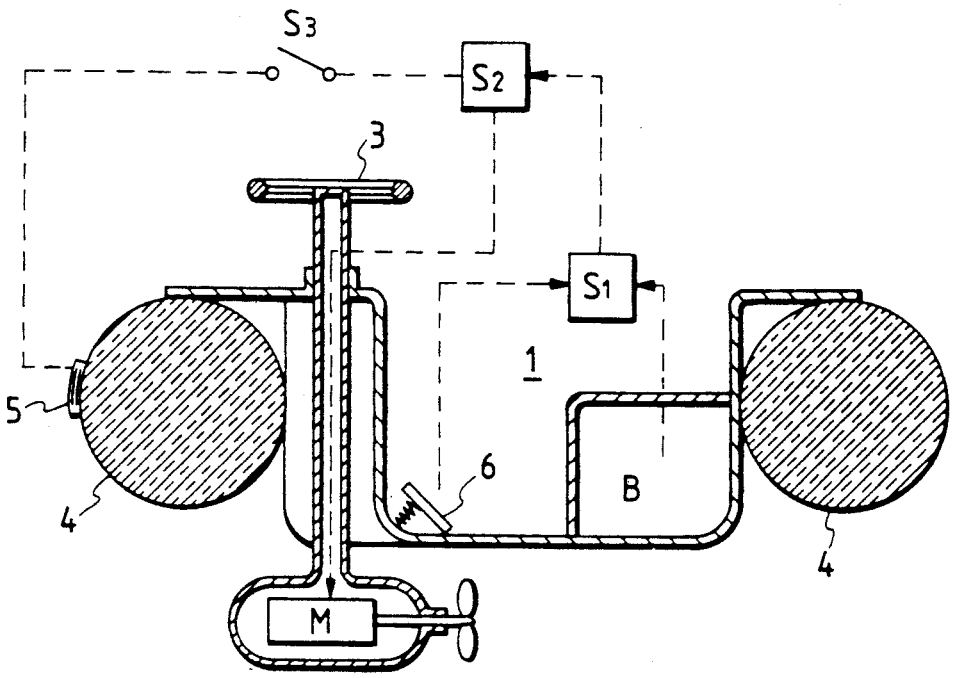
FIG. 3 is a longitudinally sectioned view illustrating another embodiment of the present invention.

An embodiment wherein a d.c. motor is used for the engine 23 will now be explained with reference to FIG. 3.

A d.c. motor 23' used is reversible, and is fed with power from a chargeable battery B through a foot switch S1 and a reversible changeover switch S2. The battery B is placed in a chair 11 provided at the stern of the boat body 1.

A foot pedal 6 positioned on the bottom of the boat, adjacent to the propeller unit 2, serves to actuate the foot switch S1 to perform an on/off control and/or control an electrical resistance. The foot switch S1 is connected to the reversible changeover switch S2. The switch S2 receives a contact or collision signal from the sensor 5 through a manual switch S3 and changes over the direction of rotation of the d.c. motor 23' in response to the resulting d.c. signal, thereby permitting the boat to change its direction. The function for changing the direction of the boat may be selectively immobilized by the manual switch S3.

As detailed above, the leisure boat according to the present invention changes direction abruptly and unexpectedly, moves backwardly and turns, when it strikes against another boat, the shore of the pond, etc, thus adding unexpected, additional interest to steering.

For that reason, the present boat may be permitted to strike purposely upon another boat, giving the boaters more pleasant thrills and more comfortableness than achieved by conventional boats which are merely designed to move forwardly.

In addition, such boating is best-suited for waters jammed with boats, thus offering additional advantages of making the most of ponds or pools so limited that they are less usable.

What is claimed is:

1. A leisure boat in a round form having a diameter of about 1 to 2 meters, comprising;

a motor casing disposed beneath the bottom of the boat and at a position offset from the center of the boat toward the front of the boat;

a steering wheel rotatabe throughout 360° mounted on the boat and coupled to said motor casing through a steering shaft;

a reversible D.C. motor disposed in said motor casing;

propeller means coupled to said motor;

battery means offset from the center of the boat toward the rear of the boat;

a foot pedal positioned on the bottom of the boat;

a sensor means attached to the outside of the boat for sensing the application of external force applied to the boat; and switch means including a manual switch, a reversible changeover switch, and a foot switch to selectively feed power from said battery through said foot switch and said reversible changeover switch to said motor, said foot pedal being adapted to control said foot switch.

said sensor means being so connected through said manual switch to said reversible changeover switch such that when the boat comes in contact with or collides with another object, said sensor means detects the resulting external force and sends a signal to said reversible changeover switch, thereby changing the driving direction.

* * * * *